US011572679B2

(12) United States Patent
Halloran et al.

(10) Patent No.: US 11,572,679 B2
(45) **Date of Patent: *Feb. 7, 2023**

(54) SYSTEMS AND METHODS FOR COUPLING A TANK OF A TOILET TO A PEDESTAL OF THE TOILET

(71) Applicant: Kohler Co., Kohler, WI (US)

(72) Inventors: Daniel N. Halloran, Fredonia, WI (US); Tony L. Lambert, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 95 days.

This patent is subject to a terminal disclaimer.

(21) Appl. No.: 17/177,949

(22) Filed: Feb. 17, 2021

(65) Prior Publication Data

US 2021/0164210 A1 Jun. 3, 2021

Related U.S. Application Data

(63) Continuation of application No. 16/558,522, filed on Sep. 3, 2019, now Pat. No. 10,954,659.

(51) Int. Cl.
*E03D 1/26* (2006.01)
*E03D 11/17* (2006.01)

(52) U.S. Cl.
CPC ..... *E03D 1/26* (2013.01); *E03D 11/17* (2013.01)

(58) Field of Classification Search
CPC ..... E03D 1/26; E03D 1/012; E03D 11/13; E03D 11/16; E03D 11/17; F16L 27/02; F16L 27/023; F16L 27/04; F16L 27/047
See application file for complete search history.

(56) References Cited

U.S. PATENT DOCUMENTS 1,924,657 A 8/1933 Saine
1,970,789 A 8/1934 Helene
2,520,575 A 8/1950 Ford
(Continued)

FOREIGN PATENT DOCUMENTS

CN 2551698 Y 5/2003
CN 101517170 A 8/2009
(Continued)

OTHER PUBLICATIONS

Examination Report from Indian Patent Application No. 202014037371, dated Nov. 23, 2021, 5 pages.
(Continued)

*Primary Examiner* — Janie M Loeppke
(74) *Attorney, Agent, or Firm* — Lempia Summerfield Katz LLC

(57) ABSTRACT

A toilet includes a tank, a pedestal, and a mounting assembly. The tank includes a bottom wall. The bottom wall includes an opening and a bottom surface. The pedestal includes an opening and a top surface. The opening of the pedestal is aligned with the opening of the bottom wall. The mounting assembly includes a mounting plate, a nut, and a gasket. The mounting plate is configured to be coupled to the pedestal and includes an opening aligned with the opening of the pedestal. The nut holds the mounting plate against the bottom surface of the bottom wall and includes a rounded portion. The gasket is disposed about the opening of the pedestal and along the top surface of the pedestal and includes a concave surface that is configured for receiving the rounded portion of the nut.

20 Claims, 10 Drawing Sheets

(56) References Cited

U.S. PATENT DOCUMENTS

| | | | |
|---|---|---|---|
| 2,838,764 | A | 6/1958 | Smith |
| 3,072,919 | A | 1/1963 | Roach |
| 3,895,832 | A | 7/1975 | Ellis |
| 4,445,237 | A | 5/1984 | Paul |
| 4,757,560 | A | 7/1988 | Grimstad |
| 5,890,239 | A | 4/1999 | Hite |
| 6,327,717 | B1 | 12/2001 | Johnson |
| 6,728,976 | B1 | 5/2004 | Halloran |
| 7,913,328 | B2 | 3/2011 | Halloran |
| 9,487,937 | B2 | 11/2016 | Swart |

FOREIGN PATENT DOCUMENTS

| | | | |
|---|---|---|---|
| CN | 102713097 | A | 10/2012 |
| CN | 109944309 | A | 6/2019 |
| EP | 1108821 | B1 | 2/2006 |
| GB | 519797 | A | 4/1940 |
| KR | 100890385 | B1 | 3/2009 |

OTHER PUBLICATIONS

Office Action in Chinese Patent Application No. 202010915208.1, dated Oct. 9, 2021, 6 pages (including English summary).

SYSTEMS AND METHODS FOR COUPLING A TANK OF A TOILET TO A PEDESTAL OF THE TOILET

This application is a continuation under 35 U.S.C § 120 and 37 C.F.R. § 1.53(b) of U.S. patent application Ser. No. 16/558,522 filed Sep. 3, 2019, the contents of which are incorporated herein by reference.

BACKGROUND

The present application relates generally to systems and methods for coupling a tank of a toilet to a pedestal of the toilet. In particular, this application relates to a mounting assembly that facilitates adjustment of the tank relative to the pedestal prior to coupling the tank to the pedestal.

Generally speaking, a two-piece toilet may include a tank that is separate from and coupled to a pedestal (e.g., using a two-bolt connection, etc.) that includes the toilet bowl. In such toilets, the tank is typically mounted on top of the pedestal. This mounting is typically facilitated by coupling a flush canister, positioned within the tank and extending from the tank, to a mounting plate using a nut, and then subsequently aligning a gasket with the nut, pressing the gasket onto the nut, aligning the gasket with a pedestal inlet on the pedestal, and coupling the mounting plate to the pedestal. Using this arrangement, vertical alignment of the tank relative to the pedestal is accomplished by tightening or loosening the nut and horizontal alignment of the tank relative to the pedestal is accomplished by horizontally moving the mounting plate relative to the pedestal. As such, alignment of the tank relative to the pedestal is tedious and often difficult to perform. This alignment can be made even more difficult if the mounting plate were inadvertently bent by a user. Furthermore, the multitude of connection points between the tank and the pedestal increase the likelihood that a leak of the toilet will occur.

SUMMARY

One embodiment of the present disclosure is related to a toilet. The toilet includes a tank, a pedestal, and a mounting assembly. The tank includes a bottom wall. The bottom wall includes an opening and a bottom surface. The pedestal includes an opening and a top surface. The opening of the pedestal is aligned with the opening of the bottom wall. The mounting assembly includes a mounting plate, a nut, and a gasket. The mounting plate is configured to be coupled to the pedestal and includes an opening aligned with the opening of the pedestal. The nut holds the mounting plate against the bottom surface of the bottom wall and includes a rounded portion. The gasket is disposed about the opening of the pedestal and along the top surface of the pedestal and includes a concave surface that is configured for receiving the rounded portion of the nut. The nut and gasket facilitate tilting of the tank relative to the pedestal when the mounting plate is partially coupled to the pedestal. The rounded portion of the nut rotates within the concave surface of the gasket when the tank is tilted relative to the pedestal to facilitate positioning of the tank.

Another embodiment of the present disclosure is related to a mounting assembly for a toilet having a tank and a pedestal. The mounting assembly includes a mounting plate, a nut, and a gasket. The mounting plate is configured to be coupled to the pedestal and the tank and includes an opening. The nut is configured to hold the mounting plate against a bottom wall of the tank and includes a rounded portion.

The gasket includes a concave surface that is configured to receive the rounded portion of the nut and to be held against a top surface of the pedestal when the mounting plate is coupled to the pedestal. The gasket and the nut are configured to facilitate tilting of the tank relative to the pedestal when the nut is holding the mounting plate against the bottom wall and the gasket is held against the top surface of the pedestal.

Yet another embodiment of the present disclosure is related to a process for coupling a tank of a toilet to a pedestal of a toilet. The process includes inserting an insert portion of a flush canister into an opening of a bottom wall of the tank. The process also includes threading a nut onto the insert portion of the flush canister. The process also includes placing a gasket on a top surface of the pedestal. The process also includes inserting the nut into the gasket. The process also includes inserting fasteners into holes of the pedestal. The process also includes partially threading the fasteners into fastener nuts. The process also includes tilting the tank relative to the pedestal so as to cause a rounded portion of the nut to rotate within a concave surface of the gasket. The process also includes tightening the fasteners into the fastener nuts, after tilting the tank relative to the pedestal, so that the tank is secured to the pedestal.

It is to be understood that both the foregoing general description and the following detailed description are exemplary and explanatory only and are not restrictive of the invention as claimed.

DETAILED DESCRIPTION

Before turning to the figures, which illustrate certain exemplary embodiments in detail, it should be understood that the present application is not limited to the details or methodology set forth in the description or illustrated in the figures. It should also be understood that the terminology is for the purpose of description only and should not be regarded as limiting.

A toilet may include a tank and a pedestal. When the toilet is installed, it is sometimes desired to adjust the tank relative to the pedestal. The tank is typically coupled to the pedestal using a flush canister, which extends through a hole in the tank. A plate may be placed over the flush canister, and a nut may be used to secure the plate to the tank. By adjusting the tightness of the nut on the flush canister, the vertical position of the tank relative to the pedestal may be adjusted. The nut may be subsequently placed in a gasket which is seated in an opening in the pedestal. The nut may have flat sides and the gasket may have an opening with flat sides that are configured to mate with the flat sides of the nut. This flat-on-flat interface between the nut and the gasket provides a seal. However, as a consequence of this flat-on-flat interface between the nut and the gasket, tilting of the nut relative to a center axis of the opening in the pedestal is prohibited. As a result, the ability of a user to adjust the tank relative to the pedestal is limited. For example, tilting of the tank relative to the pedestal is not possible. After the nut is inserted into the gasket, the plate may be fastened to the pedestal.

Various embodiments herein relate to a toilet that includes a tank, a pedestal, and a mounting assembly. The mounting assembly includes a flush canister, a seal, a nut, a gasket, a mounting plate, and fasteners. In contrast to conventional toilets, the toilet described herein facilitates adjustment of the tank relative to the pedestal through the mounting assembly. The mounting assembly is assembled by placing the seal over the flush canister, inserting the flush canister through an opening in the tank, placing the mounting plate over the flush canister and against the tank, threading the nut onto the flush canister so that the mounting plate is held against the tank, placing the gasket on the pedestal, inserting the fasteners through the mounting plate, placing the nut on the gasket, partially threading the fasteners into the pedestal, adjusting the tank relative to the pedestal, and tightening the fasteners so that the tank is secured to the pedestal. Unlike some toilets, the nut and gasket form a ball and socket relationship which facilitates tilting of the tank relative to the pedestal and provides sealing between the nut and the gasket. In this way, the toilet described herein provides increased functionality compared to other toilets which have nuts and gaskets that require a flat-on-flat interface and prohibit tilting of the tank relative to the pedestal.

Figure 1:
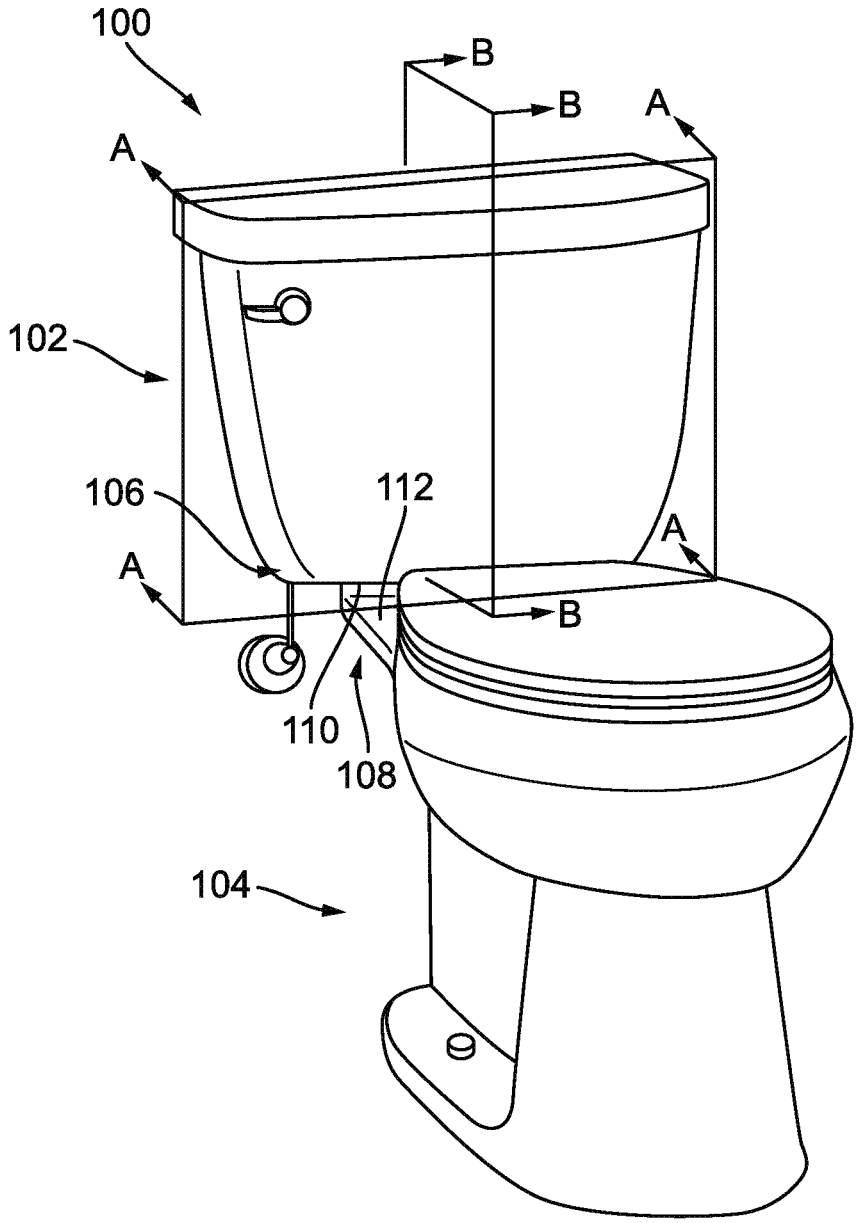
FIG. 1 is a perspective view of a toilet, according to an exemplary embodiment of the present disclosure.

Referring now to FIG. 1, a toilet 100 is illustrated according to an exemplary embodiment. The toilet 100 includes a tank (e.g., container, reservoir, etc.), shown as a tank 102, and a pedestal (e.g., base, stand, support, etc.), shown as a pedestal 104. The tank 102 is coupled to, and supported by, the pedestal 104, which is configured to be positioned on a floor. The tank 102 is configured to receive water (e.g., via a fill valve of the toilet 100, etc.) and store the water in between flushes. The pedestal 104 includes a bowl and is configured to receive the water from the tank 102 to flush contents of bowl into a sewage line.

The tank 102 includes a wall (e.g., boundary, body, structure, etc.), shown as a bottom wall 106, and the pedestal 104 includes a protrusion (e.g., projection, extension, etc.), shown as a lip 108. The bottom wall 106 defines a surface (e.g., side, face, etc.), shown as a bottom surface 110. The lip 108 extends (e.g., protrudes, projects, etc.) underneath the bottom wall 106 and includes a surface, shown as a top surface 112. The tank 102 is coupled to the pedestal 104 such that the bottom surface 110 of the bottom wall 106 is adjacent to (e.g., opposite of, in confronting relation with, etc.) the top surface 112 of the pedestal 104.

Figure 2:
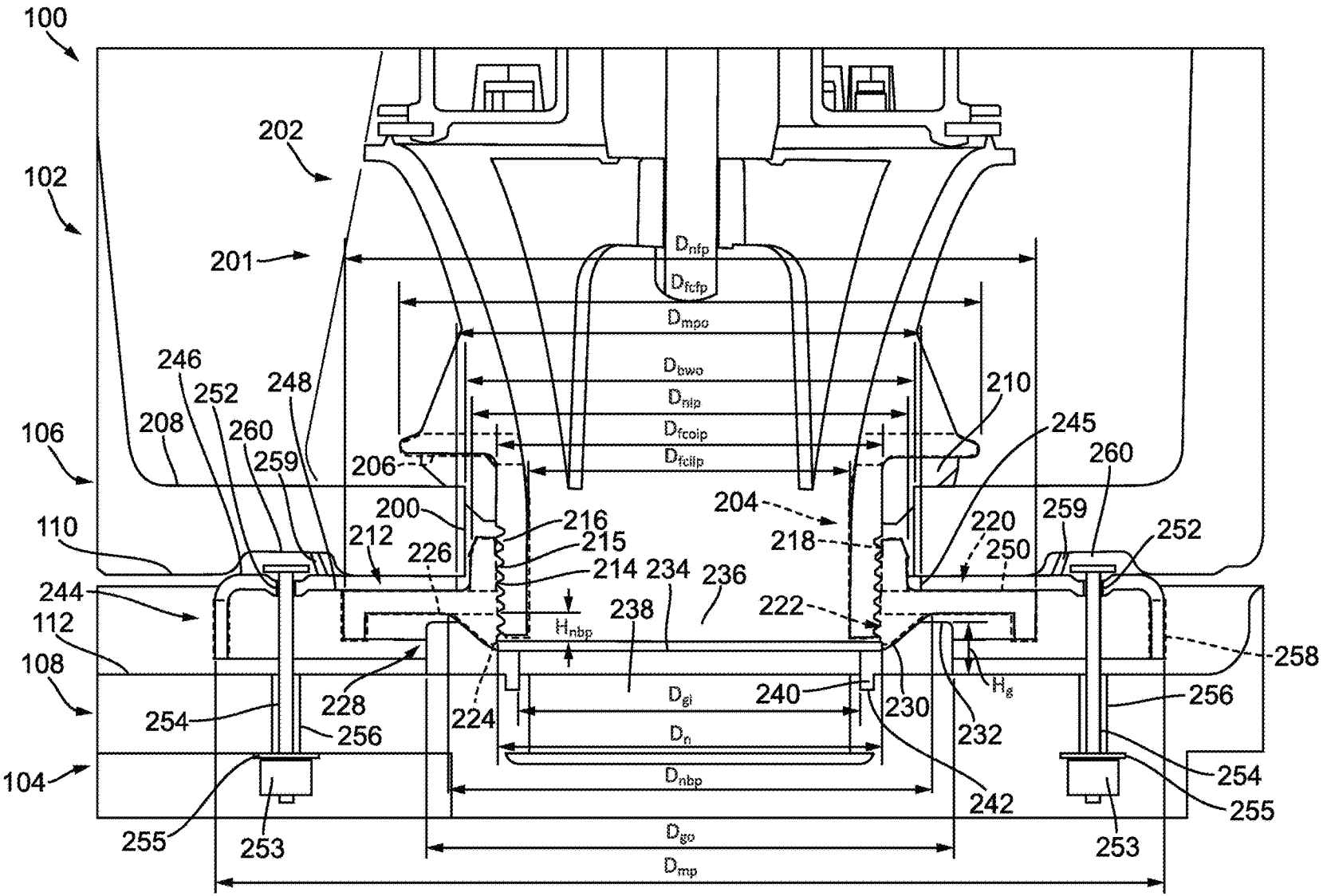
FIG. 2 is a detailed cross-sectional view of the toilet shown in FIG. 1, taken about plane A-A, and illustrating a mounting assembly, according to an exemplary embodiment of the present disclosure.
Figure 3:
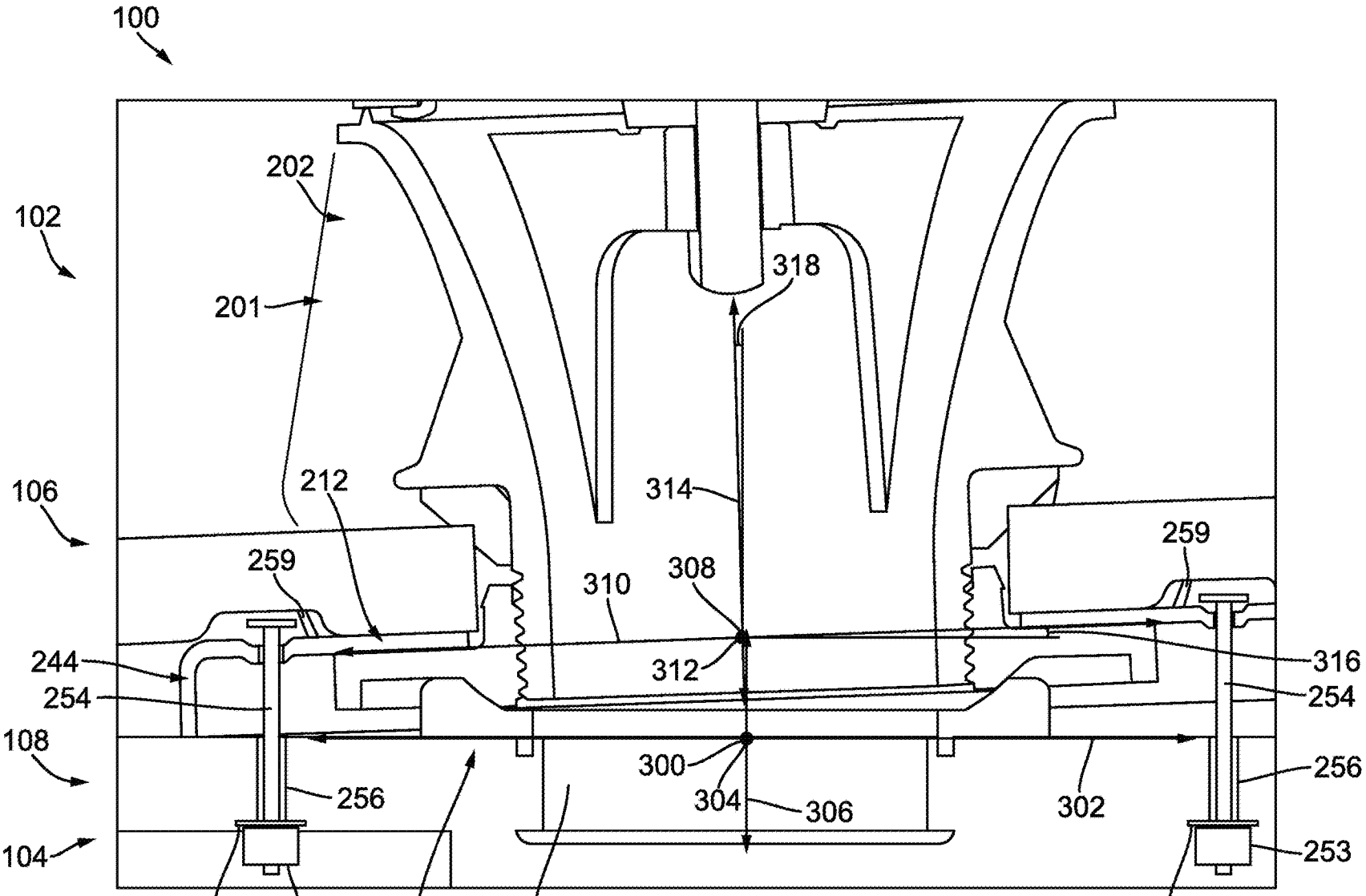
FIG. 3 is another detailed cross-sectional view of the toilet shown in FIG. 1, taken about plane A-A, and illustrating a mounting assembly, according to an exemplary embodiment of the present disclosure.

FIGS. 2 and 3 illustrate a cross-sectional view of a portion of the toilet 100 taken about plane A-A, illustrating the mounting assembly. The bottom wall 106 defines an opening (e.g., hole, etc.), shown as an opening 200. The opening 200 of the bottom wall 106 is defined by a bottom wall opening diameter $D_{bwo}$.

The toilet 100 further includes a system (e.g., assembly, etc.), shown as a mounting assembly 201. As will be explained in more detail herein, the mounting assembly 201 is configured to couple the tank 102 to the pedestal 104 and to facilitate tilting of the tank 102 relative to the pedestal 104 prior to securing the tank 102 to the pedestal 104 such that the tank 102 can easily be aligned in a target position relative to the pedestal 104 (e.g., by moving the tank 102 independent of the pedestal 104, etc.).

The mounting assembly 201 includes a flushing base (e.g., canister, conduit, pipe, etc.), shown as a flush canister 202. As will be explained in more detail herein, the flush canister 202 is configured to convey water from the tank 102 into the pedestal 104 so as to facilitate flushing of the toilet 100.

The flush canister 202 includes a portion (e.g., body, etc.), shown as an insert portion 204 that is configured to be inserted through the opening 200 of the bottom wall 106. The insert portion 204 of the flush canister 202 is defined by a flush canister outer insert portion diameter $D_{fcoip}$ and a flush canister inner insert portion diameter $D_{fciip}$. The bottom wall opening diameter $D_{bwo}$ is greater than the flush canister outer insert portion diameter $D_{fcoip}$, which is greater than the flush canister inner insert portion diameter $D_{fciip}$. In various embodiments, the flush canister inner insert portion diameter $D_{fciip}$ is between 1.5 inches and 2.75 inches, inclusive (e.g., the flush canister inner insert portion diameter $D_{fciip}$ is 1.5 inches, the flush canister inner insert portion diameter $D_{fciip}$ is 2.05 inches, the flush canister inner insert portion diameter $D_{fciip}$ is 2.25 inches, the flush canister inner insert portion diameter $D_{fciip}$ is 2.5 inches, the flush canister inner insert portion diameter $D_{fciip}$ is 2.75 inches, etc.).

The flush canister 202 also includes a portion, shown as a flange portion 206 of the flush canister 202. The flange portion 206 of the flush canister 202 is contiguous with (e.g., shares a border with, etc.), and extends radially from, the insert portion 204 of the flush canister 202. In various embodiments, the flange portion 206 of the flush canister 202 extends radially from the insert portion 204 of the flush canister 202 such that the flange portion 206 of the flush canister 202 is orthogonal to the insert portion 204 of the flush canister 202. The flange portion 206 of the flush canister 202 is defined by a flush canister flange portion diameter $D_{fcfp}$. The flush canister flange portion diameter $D_{fcfp}$ is greater than the bottom wall opening diameter $D_{bwo}$.

The flange portion 206 of the flush canister 202 is configured to remain within the tank 102 when the insert portion 204 of the flush canister 202 is inserted through the opening 200 of the bottom wall 106. Additionally, the flange portion 206 of the flush canister 202 is adjacent to a surface, shown as a top surface 208, of the bottom wall 106 when the insert portion 204 of the flush canister 202 is inserted through the opening 200 of the bottom wall 106. The top surface 208 of the bottom wall 106 is inside of the tank 102 and is opposite the bottom surface 110 of the bottom wall 106.

The mounting assembly 201 also includes a seal (e.g., gasket, O-ring, seal member, etc.), shown as a seal 210. The seal 210 is configured to be disposed about the insert portion 204 of the flush canister 202 and against the flange portion 206 of the flush canister 202. When the insert portion 204 of the flush canister 202 is inserted through the opening 200 of the bottom wall 106, the flange portion 206 of the flush canister 202 may be brought closer to the top surface 208 of the bottom wall 106 such that the seal 210 is compressed against the top surface 208 of the bottom wall 106, the flange portion 206 of the flush canister 202, and the insert portion 204 of the flush canister 202. Compression of the seal 210 in this way creates a seal between the flush canister 202 and the tank 102 (e.g., such that any leakage of water from the tank 102 via the opening 200 of the bottom wall 106 is mitigated or substantially eliminated, etc.). Additionally, compression of the seal 210 may cause a portion of the seal 210 to expand into a void (e.g., gap, etc.) defined between the opening 200 of the bottom wall 106 and the insert portion 204 of the flush canister 202.

The mounting assembly 201 also includes a nut threaded member, spherical nut, curved nut, etc.), shown as a nut 212. The nut 212 has a surface, shown as a threaded surface 214, extendible about an opening, shown as an opening 215, of the nut 212. The threaded surface 214 of the nut 212 is defined by a nut diameter $D_n$. The nut diameter $D_n$ may be approximately equal to the flush canister insert portion outer diameter $D_{fcoip}$. The insert portion 204 of the flush canister 202 is partially threaded and includes a surface (e.g., side, face, etc.), shown as a threaded surface 216. The threaded surface 214 of the nut 212 has threads that match threads on the threaded surface 216 of the flush canister 202. Through the threaded surface 214 of the nut 212 and the threaded surface 216 of the flush canister 202, the nut 212 may be threaded onto the insert portion 204 of the flush canister 202.

The nut 212 includes a portion, shown as an insert portion 218. The insert portion 218 of the nut 212 is configured to be received within the opening 200 of the bottom wall 106. A portion of the threaded surface 214 of the nut 212 is an inner surface of the insert portion 218 of the nut 212. The insert portion 218 of the nut 212 is defined by a nut insert portion diameter $D_{nip}$. The nut insert portion diameter $D_{nip}$ is less than the bottom wall opening diameter $D_{bwo}$. According to various embodiments, the nut insert portion diameter $D_{nip}$ is greater than or equal to 95% of the bottom wall opening diameter $D_{bwo}$. In this way, a void between the insert portion 218 of the nut 212 and the opening 200 of the bottom wall 106 is minimized. This functions to ensure alignment of the nut 212 and the flush canister 202 in the opening 200 of the bottom wall 106 (e.g., such that a center axis of the opening 215 of the nut 212, a center axis of an opening of the flush canister, and a center axis of the opening 200 of the bottom wall 106 are substantially coincident, etc.). This may aid in mitigating or substantially eliminating any leakage of water between the insert portion 218 of the nut 212 and the opening 200 of the bottom wall 106.

The nut 212 also includes another portion, shown as a flange portion 220. The flange portion 220 of the nut 212 is contiguous with the insert portion 218 of the nut 212. A portion of the threaded surface 214 of the nut 212 is an inner surface of the flange portion 220 of the nut 212. The flange portion 220 of the nut 212 is configured to extend radially outward from the insert portion 218 of the nut 212. As will be explained in more detail herein, the flange portion 220 of the nut 212 extends underneath the bottom wall 106 of the tank 102. The flange portion 220 of the nut 212 is defined by a nut flange portion diameter $D_{nfp}$ that is greater than the bottom wall opening diameter $D_{bwo}$. In various embodiments, the nut flange portion diameter $D_{nfp}$ is greater than the flush canister flange portion diameter $D_{fcfp}$.

The nut 212 also includes another portion, shown as a rounded portion 222 of the nut 212. The rounded portion 222 of the nut 212 is contiguous with the flange portion 220 of the nut 212. A portion of the threaded surface 214 of the nut 212 is an inner surface of the rounded portion 222 of the nut 212. The rounded portion 222 of the nut 212 is defined by a nut rounded portion diameter $D_{nbp}$ and a nut rounded portion height $H_{nbp}$. The nut rounded portion diameter $D_{nbp}$ is greater than the nut diameter $D_n$. In various embodiments, the nut rounded portion diameter $D_{nbp}$ is greater than the bottom wall opening diameter $D_{bwo}$.

The rounded portion 222 of the nut 212 includes a surface, shown as a rounded surface 224, of the nut 212, and another surface, shown as a concave surface 226, of the nut 212. The rounded surface 224 of the rounded portion 222 of the nut 212 is generally rounded with respect to the threaded surface 214 of the nut 212. In other words, the rounded surface 224 of the rounded portion 222 of the nut 212 is contiguous with the threaded surface 214 of the nut 212 and curves (e.g., slopes, transitions, etc.) gradually away from the threaded surface 214 of the nut 212 while curving gradually towards the flange portion 220 of the nut 212. The rounded surface 224 of the rounded portion 222 of the nut 212 may be considered substantially 'spherical' due to this rounded shape. As will be explained in more detail herein, the rounded surface 224 of the rounded portion 222 of the nut 212 forms a ball of a first ball and socket relationship that facilitates tilting of the nut 212 relative to the pedestal 104. The concave surface 226 of the rounded portion 222 of the nut 212 is generally concave and forms a socket of a second ball and socket relationship that will be described in more detail herein. In various embodiments, the nut 212 is made from a plastic. In other embodiments, the nut 212 is metallic (e.g., brass, aluminum, etc.).

The mounting assembly 201 also includes a seal, shown as a gasket 228. The gasket 228 is configured to be located between the nut 212 and the top surface 112 of the pedestal 104. The gasket 228 is defined by a gasket outer diameter $D_{go}$, a gasket inner diameter $D_{gi}$, and a gasket height $H_g$. The gasket outer diameter $D_{go}$ is greater than the nut diameter $D_n$ and less than the nut flange portion diameter $D_{nfp}$. The gasket inner diameter $D_{gi}$ is less than the nut diameter $D_n$. In various embodiments, the nut diameter $D_n$ is greater than the flush canister insert portion inner diameter $D_{fciip}$. The gasket height $H_g$ is greater than the nut rounded portion height $H_{nbp}$. In various embodiments, the gasket height $H_g$ is between 1.4 and 1.6 times the nut rounded portion height $H_{nbp}$. It is understood that the gasket height $H_g$, the nut rounded portion height $H_{nbp}$, and other values may be varied and selected such that the mounting assembly 201 is tailored for a target application.

The gasket 228 includes a surface, shown as a concave surface 230, and another surface, shown as a rounded surface 232 of the gasket 228. The concave surface 230 of the gasket 228 is generally concave and, together with the rounded surface 224 of the rounded portion 222 of the nut 212, forms a first ball and socket relationship. The rounded surface 232 of the gasket 228 is similar to the rounded surface 224 of the rounded portion 222 of the nut 212 and is generally rounded. Together, with the concave surface 226 of the rounded portion 222 of the nut 212, the rounded surface 232 of the gasket 228 forms a second ball and socket relationship. The concave surface 230 of the gasket 228, the rounded surface 224 of the rounded portion 222 of the nut 212, the rounded surface 232 of the gasket 228, and the concave surface 226 of the rounded portion 222 of the nut 212 cooperate to facilitate tilting of the nut 212 relative to the pedestal 104. Specifically, the rounded shape of the rounded surface 224 of the rounded portion 222 of the nut 212 is configured to rotate within the concave shape of the concave surface 230 of the gasket 228 and the rounded shape of the rounded surface 232 of the gasket 228 is configured to rotate within the concave surface 226 of the rounded portion 222 of the nut 212. This tilting can be in a first direction (e.g., about a first axis that bisects the opening 215 of the nut 212, etc.), in a second direction (e.g., about a second axis that bisects the opening 215 of the nut 212 and is orthogonal to the first axis that bisects the opening 215 of the nut 212, etc.), or in the first direction and the second direction. An example tilting of the nut 212 relative to the pedestal 104 is shown in FIG. 3.

The gasket 228 defines an opening, shown as an opening 234. The opening 234 of the gasket 228 is in fluid communication (e.g., configured to receive water from, etc.) an opening, shown as an opening 236, of the flush canister 202 and in fluid communication (e.g., configured to provide water to, etc.) an opening, shown as an opening 238, in the pedestal 104. In various embodiments, the gasket 228 and the pedestal 104 are configured such that the opening 234 of the gasket 228 and the opening 238 of the pedestal 104 are aligned and remain aligned irrespective of tilting of the nut 212 relative to the pedestal 104.

The gasket 228 also includes a protrusion, shown as a rib 240. The rib 240 of the gasket 228 partially or completely circumscribes the opening 234 of the gasket 228. In some embodiments, the rib 240 of the gasket 228 is contiguous with the opening 234 of the gasket 228. The pedestal 104 includes a recess (e.g., void, depression, etc.), shown as a recess 242. The recess 242 of the pedestal 104 is contiguous with the top surface 112 of the pedestal 104. The recess 242 of the pedestal 104 partially or completely circumscribes the opening 238 of the pedestal 104. The recess 242 of the pedestal 104 is configured to receive the rib 240 of the gasket 228. The engagement between the rib 240 of the gasket 228 and the recess 242 of the pedestal 104 creates a co-axial relationship between the opening 238 of the pedestal 104 and the opening 234 of the gasket 228. This may also create a co-axial relationship between the opening 238 of the pedestal 104, the opening 215 of the nut 212, the opening 236 of the flush canister 202, and the opening 200 of the bottom wall 106. Additionally, the engagement between the rib 240 of the gasket 228 and the recess 242 of the pedestal 104 may function to enhance the seal formed between the gasket 228 and the top surface 112 of the pedestal 104. In some embodiments, the gasket 228 does not include the rib 240 of the gasket 228 and the pedestal 104 does not include the recess 242 of the pedestal 104. In various embodiments, the gasket 228 is made from an elastomeric material (e.g., nitrile rubber, Buna-N, Viton® fluroelastomer, etc.).

The mounting assembly 201 also includes a plate (e.g., flange, etc.), shown as a mounting plate 244. The mounting plate 244 is configured located between the nut 212 and the bottom surface 110 of the bottom wall 106. The mounting plate 244 defines an opening, shown as an opening 245. The opening 245 of the mounting plate 244 is configured to receive the insert portion 218 of the nut 212. The opening 245 of the mounting plate 244 is defined by a mounting plate opening diameter $D_{mpo}$. The mounting plate opening diameter $D_{mpo}$ is greater than the nut insert portion diameter $D_{nip}$ and less than the nut flange portion diameter $D_{nfp}$. In various embodiments, the mounting plate opening diameter $D_{mpo}$ is greater than the bottom wall opening diameter $D_{bwo}$.

The mounting plate 244 includes a surface, shown as a top surface 246, that is configured to interface with (e.g., contact, etc.) the bottom surface 110 of the bottom wall 106 and another surface, shown as a bottom surface 248, that is configured to interface with a surface, shown as a top surface 250, of the flange portion 220 of the nut 212. The top surface 250 of the flange portion 220 of the nut 212 is opposite the rounded portion 222 of the nut 212. The mounting plate 244 and the bottom wall 106 may be configured to create a seal between the bottom surface 110 of the bottom wall 106 and the top surface 246 of the mounting plate 244 proximate the opening 200 of the bottom wall 106 because the bottom surface 110 of the bottom wall 106 is flat proximate the opening 200 of the bottom wall 106 and the top surface 246 of the mounting plate 244 is flat proximate the opening 200 of the bottom wall 106. The mounting plate 244 and the nut 212 may also be configured to create a seal between the bottom surface 248 of the mounting plate 244 and the top surface 250 of the flange portion 220 of the nut 212 proximate the opening 200 of the bottom wall 106 because the bottom surface 248 of the mounting plate is flat proximate the opening 200 of the bottom wall 106 and the top surface 250 of the flange portion 220 of the nut 212 is flat proximate the opening 200 of the bottom wall 106.

The mounting plate 244 also includes two openings, shown as holes 252. The holes 252 of the mounting plate 244 extend through the mounting plate 244, from the top surface 246 of the mounting plate 244 to the bottom surface 248 of the mounting plate 244. The holes 252 of the mounting plate 244 are each configured to receive a fastener (e.g., bolt, screw, fastening member, etc.), shown as a fastener 254. In various embodiments, the holes 252 of the mounting plate 244 are not threaded. However, in other embodiments, the holes 252 of the mounting plate 244 are threaded.

The pedestal 104 includes holes, shown as holes 256, that are configured to receive the fasteners 254. The holes 256 in the pedestal 104 extend from the top surface 112 of the pedestal 104 into the pedestal 104. In various applications, the holes 256 are through holes (e.g., are not threaded, etc.). In such applications, the fasteners 254 are secured to the pedestal 104 using nuts, shown as fastener nuts 253, and washers, shown as washers 255. In other applications, the holes 256 in the pedestal 104 are threaded and configured to engage the fasteners 254.

The mounting plate 244 and the pedestal 104 are configured such that when the insert portion 204 of the flush canister 202 is received within the opening 200 of the bottom wall 106, the insert portion 218 of the nut 212 is received within the opening 245 of the mounting plate 244, the insert portion 204 of the flush canister 202 is received within the opening 215 of the nut 212 (e.g., the threaded surface 214 of the nut 212 is engaged with the threaded surface 216 of the flush canister 202), the rounded portion 222 of the nut 212 is received within the gasket 228, and the rib 240 of the gasket 228 is received within the recess 242 of the pedestal 104, the holes 252 of the mounting plate 244 are aligned with the holes 256 in the pedestal 104 such that each fastener 254 can extend through both a hole 256 in the pedestal 104 and a hole 252 in the mounting plate 244. The fasteners 254 can then be tightened (e.g., using the fastener nuts 253 and the washers 255, etc.) such that the mounting plate 244 is coupled to the pedestal 104. The mounting plate 244 is not coupled to the tank 102 using a fastener. Instead, the interaction between the nut 212, the flush canister 202, the mounting plate 244 and the bottom wall 106 couples the mounting plate 244 to the tank 102. In this way, the tank 102 is coupled to the pedestal 104.

When using the mounting assembly 201, the fasteners 254 are first inserted into the holes 256 in the pedestal 104. The fasteners 254 are then partially threaded into the fastener nuts 253. This provides a limited coupling of the mounting plate 244, and therefore of the tank 102, to the pedestal 104. Additionally, friction (e.g., static friction, etc.) between the nut 212 and the gasket 228 resists movement of the tank 102 relative to the pedestal 104 during this limited coupling. At this point, the tank 102 may be tilted relative to the pedestal 104 such that the tank 102 can be aligned in a target position relative to the pedestal 104 when the tank 102 is coupled to the pedestal 104. Once the tank 102 is aligned in the target position, the fasteners 254 are further threaded into the fastener nuts 253 that the mounting plate 244, and therefore the tank 102, is coupled to the pedestal 104. When the fasteners 254 are further tightened into the fastener nuts 253, the nut 212 is drawn against the gasket 228. The nut 212 is rigid and the gasket 228 is compressible. As a result, this drawing of the nut 212 against the gasket 228 causes the nut 212 to compress the gasket 228. This compression causes a seal to be formed between the nut 212 and the gasket 228. This compression also increases the friction between the nut 212 and the gasket 228, which resists movement of the tank 102 relative to the pedestal 104 such that the tank 102 is secured to the pedestal 104 while also forming a seal between the nut 212 and the gasket 228 (e.g., such that any leakage of water between the nut 212 and the gasket 228 is mitigated or substantially eliminated, etc.).

The mounting plate 244 also includes a flange, shown as a flange 258. The flange 258 of the mounting plate 244 is configured to extend towards the top surface 112 of the pedestal 104. The flange 258 of the mounting plate 244 adds strength to the mounting plate 244 to resist bending forces caused by the fasteners 254 (e.g., due to tightening of the fasteners 254 into the fastener nuts 253, etc.) and reaction forces caused by compression of the gasket 228. In some applications, the flange 258 of the mounting plate 244 may be configured to limit tilting of the nut 212 relative to the pedestal 104 and to limit tightening of the mounting plate 244 onto the pedestal 104. These limits are caused by contact between the flange 258 of the mounting plate 244 and the top surface 112 of the pedestal 104.

The mounting plate 244 also includes projections (e.g., tabs, protuberances, etc.), shown as tabs 259, projecting upwards from the top surface 246 of the mounting plate 244 (e.g., away from the bottom surface 248 of the mounting plate 244. Each of the tabs 259 is configured to deflect downwards (e.g., towards the bottom surface 248 of the mounting plate 244, etc.).

The bottom wall 106 of the tank 102 also includes recesses, shown as pockets 260. Each of the pockets 260 is configured to receive one of the tabs 259. When the tabs 259 are received within the pockets 260, rotation of the mounting plate 244 relative to the bottom wall 106 of the tank 102 is resisted or substantially prevented. Each of the tabs 259 is configured to be compressed (e.g., deflected towards the bottom surface 248 of the mounting plate 244, etc.) when the tab 259 contacts the bottom wall 106 of the tank 102 but the tab 259 is not received in one of the pockets 260 and to be extended (e.g., deflected away from the bottom surface 248 of the mounting plate 244, etc.) when the tab 259 is received in one of the pockets 260.

In contrast to some current toilets, the mounting assembly 201 facilitates coupling of the tank 102 to the pedestal 104 using only two of the fasteners 254 and does not require the use of three fasteners. By only using two of the fasteners 254, the required manufacturing precession (e.g., tolerance, etc.) of various components of the mounting assembly 201, such as the mounting plate 244, may be decreased, thereby enabling these components to be manufactured at a lower cost than would be required if three fasteners were required.

A water pathway is formed through the flush canister 202 (e.g., through an interior of the flush canister 202, etc.), the opening 200 of the bottom wall 106, the nut 212, the mounting plate 244, the gasket 228, and the opening 238 of the pedestal 104. When the tank 102 is coupled to the pedestal 104, leakage out of this water pathway is mitigated or substantially eliminated due to the construction of the mounting assembly 201.

FIG. 3 illustrates the toilet 100 with the tank 102 tilted relative to the pedestal 104. As shown in FIG. 3, the opening 238 of the pedestal 104 is defined by a point, shown as a center point 300. In various embodiments, the center point 300 of the pedestal 104 is a center of the opening 238 of the pedestal 104 along a plane upon which the top surface 112 of the pedestal 104 is disposed. The opening 238 of the pedestal 104 is bisected by an axis, shown as a first axis 302, another axis, shown as a second axis 304, and another axis, shown as a third axis 306 of the pedestal 104. The second axis 304 of the pedestal 104 is orthogonal to the first axis 302 of the pedestal 104. The third axis 306 of the pedestal 104 is orthogonal to the first axis 302 of the pedestal 104 and the second axis 304 of the pedestal 104. The first axis 302 of the pedestal 104, the second axis 304 of the pedestal 104, and the third axis 306 of the pedestal 104 intersect at the center point 300 of the pedestal 104.

The nut 212 is defined by a point, shown as a center point 308. In various embodiments, the center point 308 of the nut 212 is a center of the opening 215 of the nut 212 along a plane upon which the top surface 250 of the flange portion 220 of the nut 212 is disposed. The opening 215 of the nut 212 is bisected by an axis, shown as a first axis 310, another axis, shown as a second axis 312, and another axis, shown as a third axis 314. The second axis 312 of the nut 212 is orthogonal to the first axis 310 of the nut 212. The third axis 314 of the nut 212 is orthogonal to the first axis 310 of the nut 212 and the second axis 312 of the nut 212. The first axis 310 of the nut 212, the second axis 312 of the nut 212, and the third axis 314 of the nut 212 intersect at the center point 308 of the nut 212.

A first angle, shown as a first tilt angle 316, is defined between the first axis 302 of the pedestal 104 and the first axis 310 of the nut 212. A second tilt angle is defined between the second axis 304 of the pedestal 104 and the second axis 312 of the nut 212. A third angle, shown as a third tilt angle 318, is defined between the third axis 306 of the pedestal 104 and the third axis 314 of the nut 212. Tilting of the nut 212 relative to the pedestal 104 causes changes in at least one of the first tilt angle 316, the second tilt angle, or the third tilt angle 318. When the nut 212 is not tilted relative to the pedestal 104, the first axis 310 of the nut 212 is substantially parallel (e.g., within 0.25" of parallel, within 0.5° of parallel, etc.) to the first axis 302 of the pedestal 104, the second axis 312 of the nut 212 is substantially parallel to the second axis 304 of the pedestal 104, and the third axis 314 of the nut 212 is substantially parallel to the third axis 306 of the pedestal 104. In various embodiments, the mounting assembly 201 is configured such that the first tilt angle 316, the second tilt angle, and the third tilt angle 318 may be 3° or greater (e.g., 3°, 3.25°, 3.5°, 4°, 4.25°, 4.5°, 5°, etc.).

Figure 4:
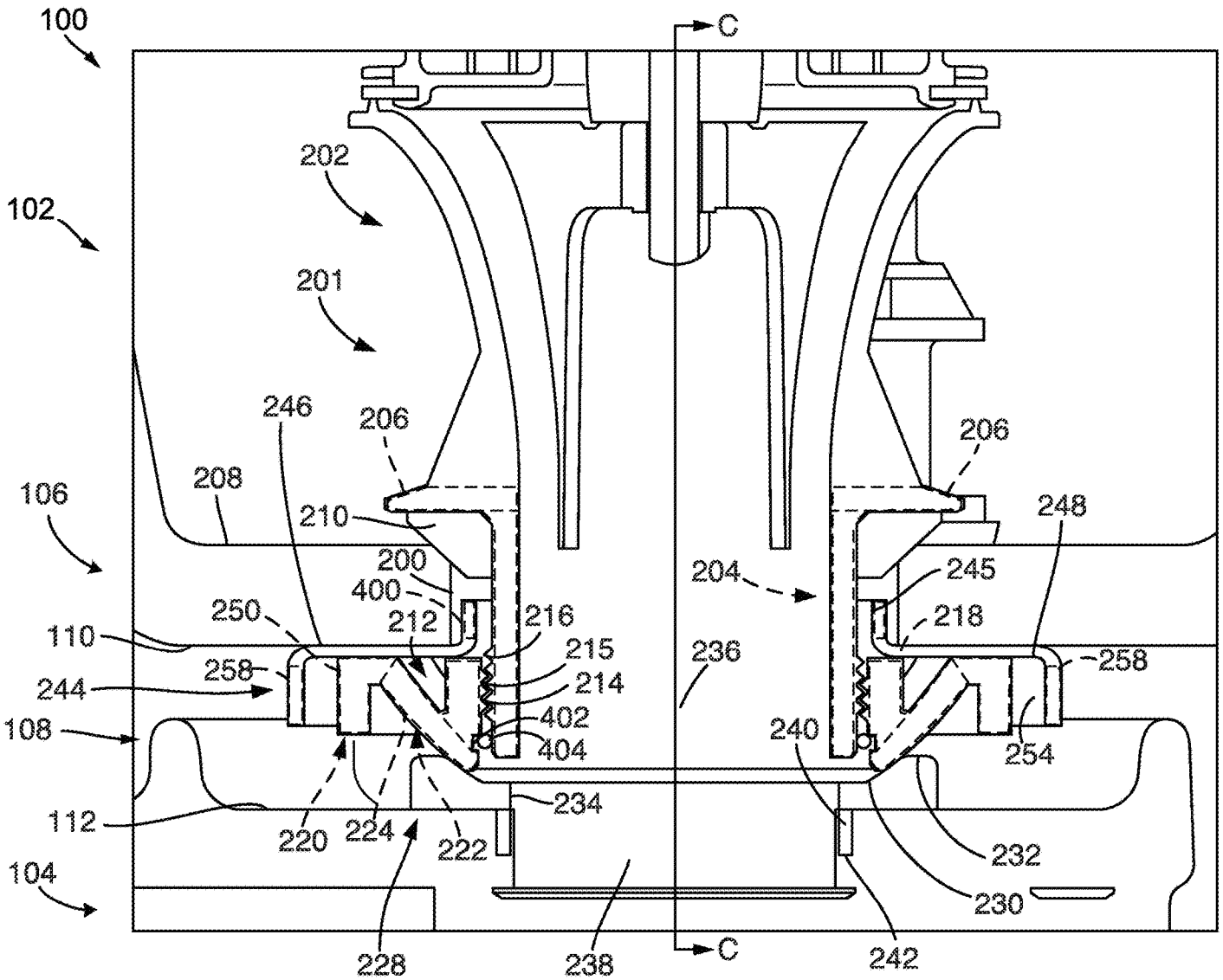
FIG. 4 is a detailed cross-sectional view of the toilet shown in FIG. 1, taken about plane B-B, and illustrating a mounting assembly, according to an exemplary embodiment of the present disclosure.
Figure 5:
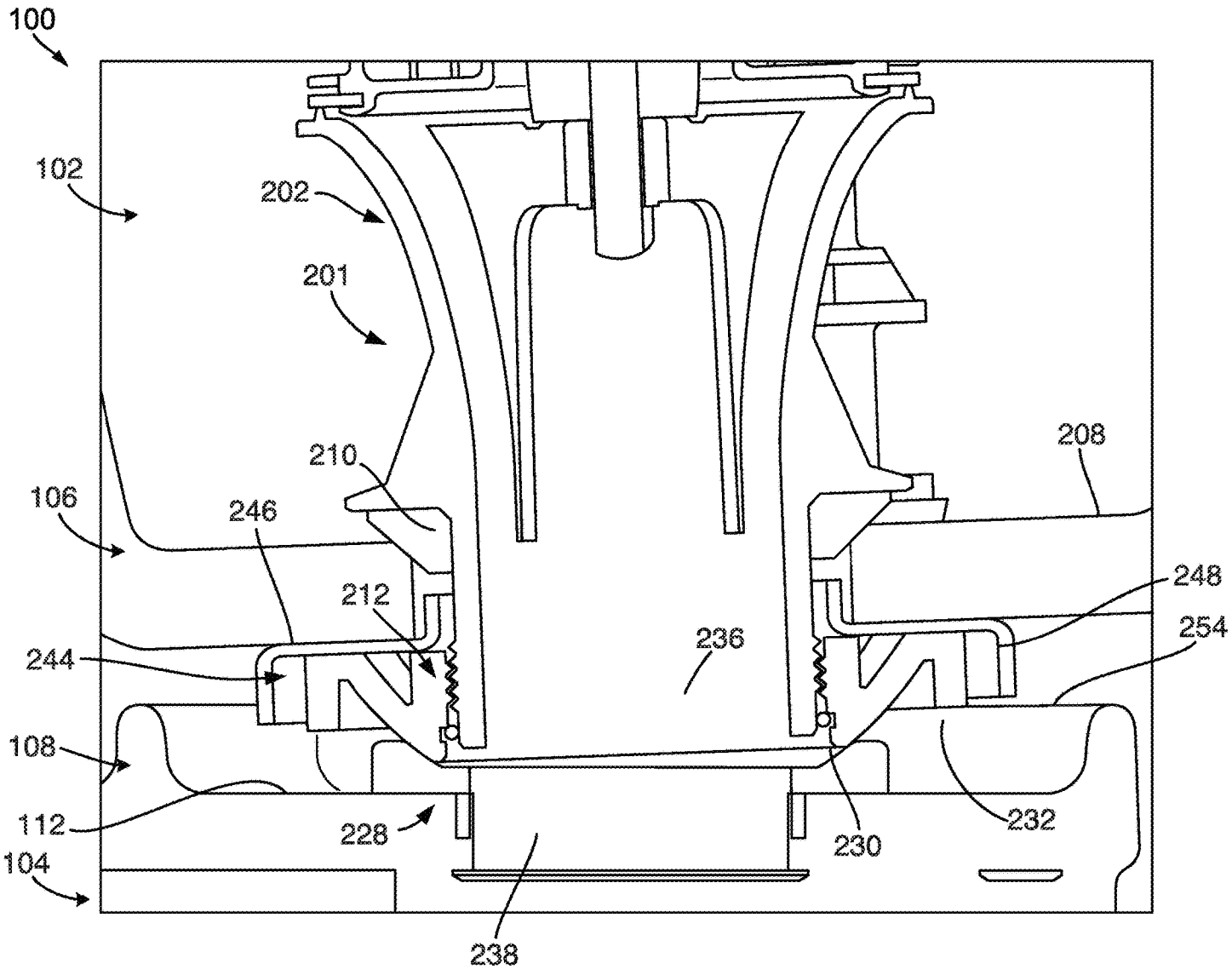
FIG. 5 is another detailed cross-sectional view of the toilet shown in FIG. 1, taken about plane B-B, and illustrating a mounting assembly, according to an exemplary embodiment of the present disclosure.
Figure 6:
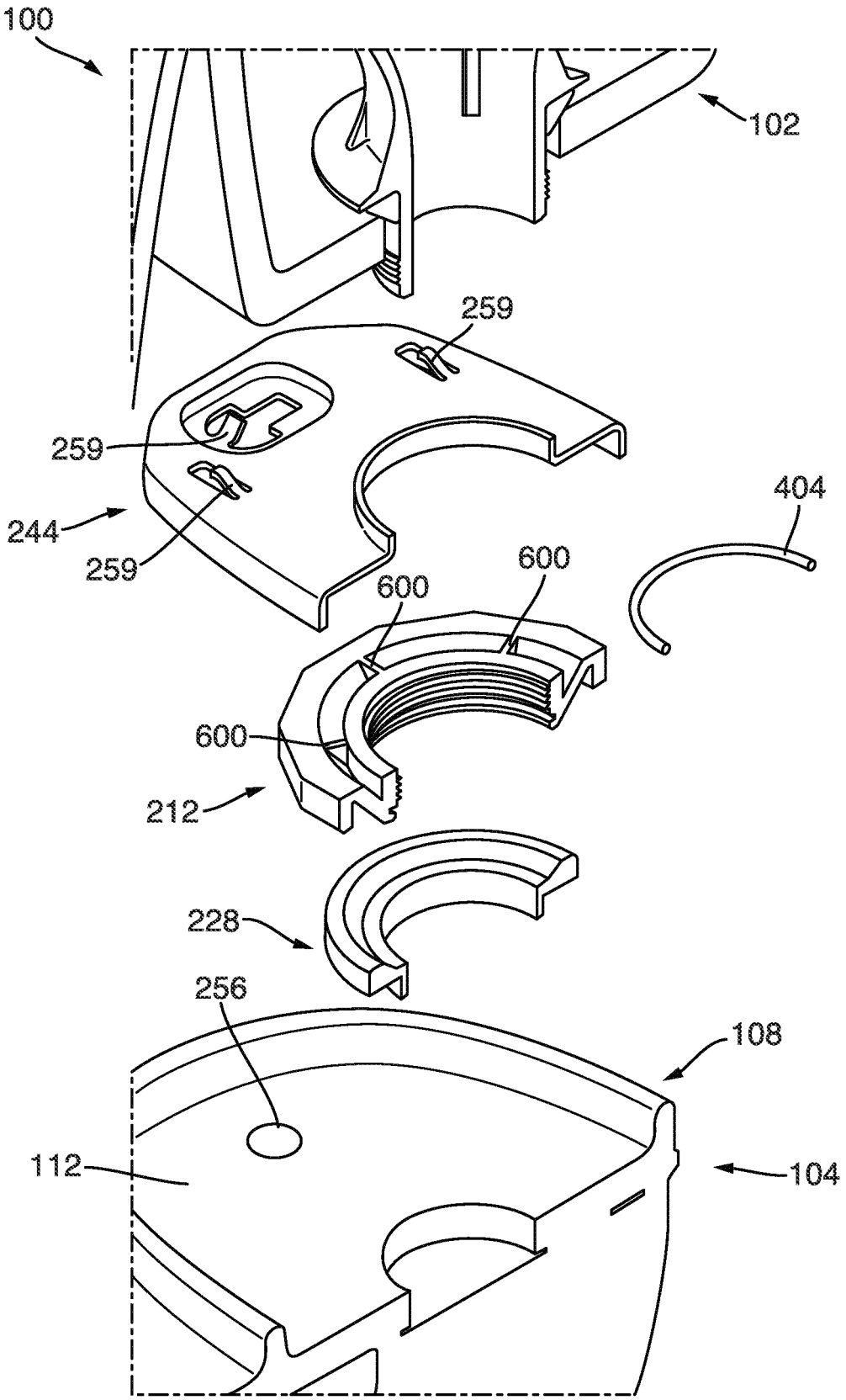
FIG. 6 is an exploded cross-sectional view of the mounting assembly illustrated in FIG. 4, taken about plane C-C, according to an exemplary embodiment of the present disclosure.
Figure 7:
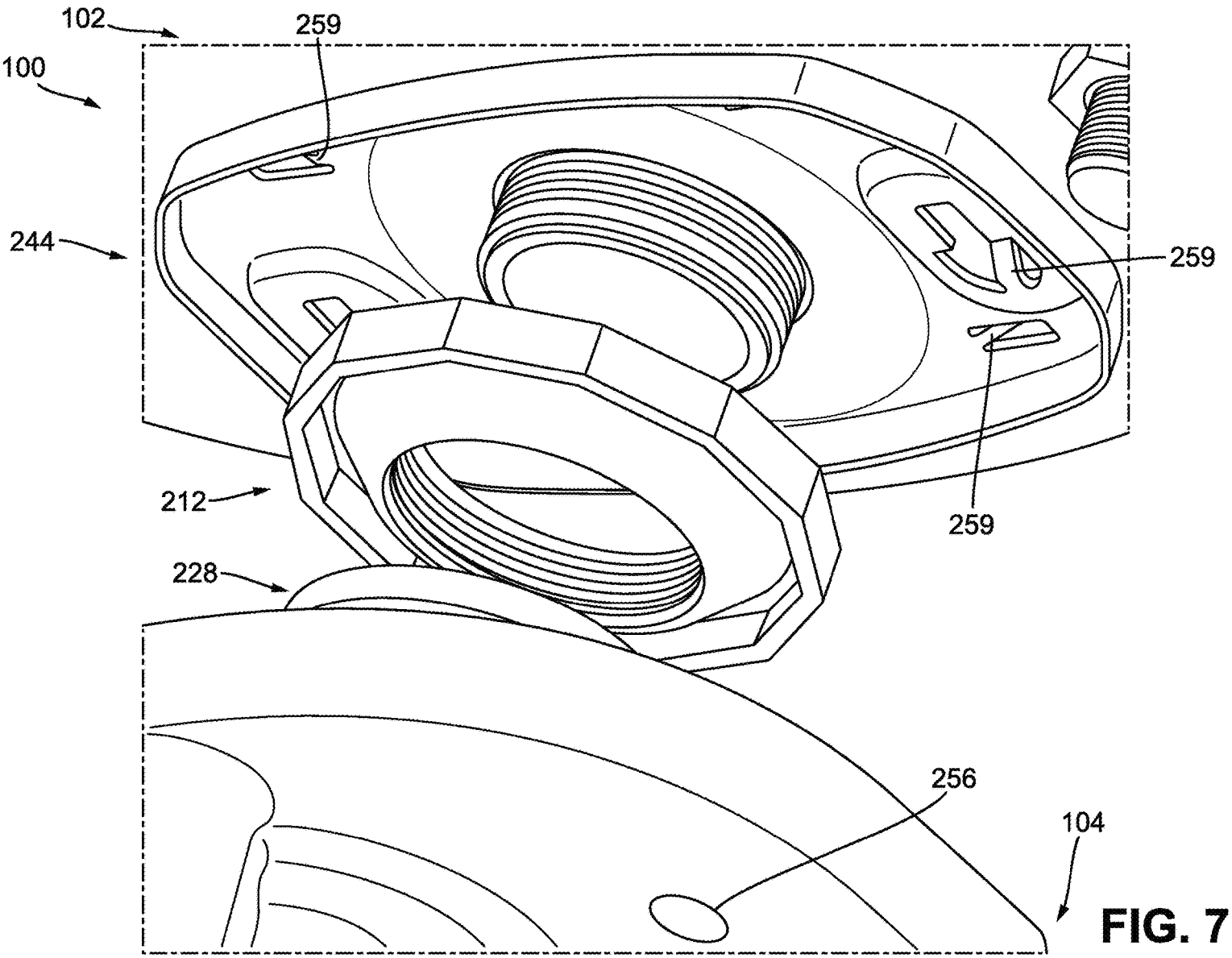
FIG. 7 is an exploded view of the mounting assembly illustrated in FIG. 4, according to an exemplary embodiment of the present disclosure.

FIGS. 4 and 5 illustrate a cross-sectional view of a portion of the toilet 100 taken about plane B-B according to various embodiments. In FIGS. 4-7, the nut 212 and the mounting plate 244 are differently configured than in FIGS. 2 and 3. The nut 212 is configured such that the rounded portion 222 does not include the concave surface 226 and instead only includes the rounded surface 224. As a result, at least a portion of the rounded surface 232 of the gasket 228 may not be received in any portion of the nut 212.

The opening 245 of the mounting plate 244 is formed via a flange, shown as an opening flange 400. The opening flange 400 of the mounting plate 244 is configured to extend from the top surface 112 of the pedestal 104. In various embodiments, the opening flange 400 is received within the opening 200 of the bottom wall 106 such that the insert portion 204 of the flush canister 202 is at least partially separated from the bottom wall 106 by the opening flange 400. The opening flange 400 of the mounting plate 244 adds strength to the mounting plate 244 to resist bending forces caused by the fasteners 254 (e.g., due to tightening of the fasteners 254 into the fastener nuts 253, etc.) and reaction forces caused by compression of the gasket 228.

Additionally, the nut 212 includes a recess (e.g., void, annular cavity, etc.), shown as a recess 402. The recess 402 is configured to be in confronting relation with the insert portion 204 of the flush canister 202. The mounting assembly 201 also includes a seal (e.g., gasket, O-ring, etc.), shown as a seal 404. The seal 404 is configured to be disposed in the recess 402 and compressed between the nut 212 and the insert portion 204 of the flush canister 202 (e.g., such that any leakage of water between the nut 212 and the insert portion 204 of the flush canister 202 is mitigated or substantially eliminated, etc.).

The nut 212 also includes a plurality of walls (e.g., beams, etc.), shown as inner walls 600. Each of the inner walls 600 extends from the insert portion 218 of the nut 212 to the rounded portion 222 of the nut 212. The inner walls 600 add strength to the nut 212 to resist bending forces caused by the fasteners 254 (e.g., due to tightening of the fasteners 254 into the fastener nuts 253, etc.) and reaction forces caused by compression of the gasket 228.

The mounting plate 244 is shown as including six of the tabs 259. However, it is understood that the mounting plate 244 may not include any of the tabs 259 in some embodiments or may include different numbers (e.g., one, two, three, four, five, seven, eight, ten, etc.) of the tabs 259 in other embodiments.

Figure 8:
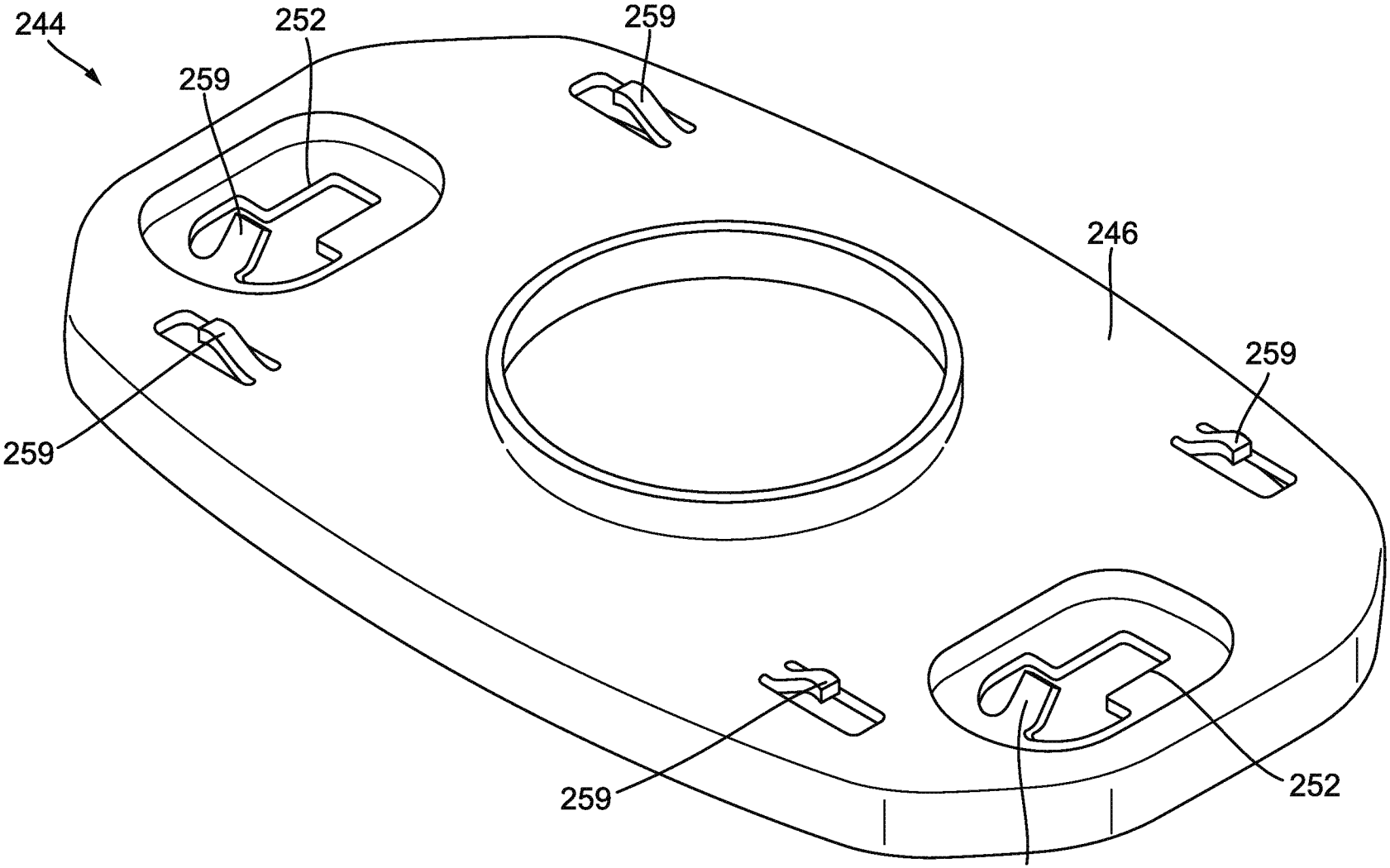
FIG. 8 is a perspective view of a mounting plate for a mounting assembly, according to an exemplary embodiment of the present disclosure.

FIG. 8 illustrates the mounting plate 244 in greater detail. As shown in FIG. 8, two of the tabs 259 are each contiguous with one of the holes 252 in the mounting plate 244 while the remaining four tabs 259 are separate from the holes 252 of the mounting plate 244.

Figure 9:
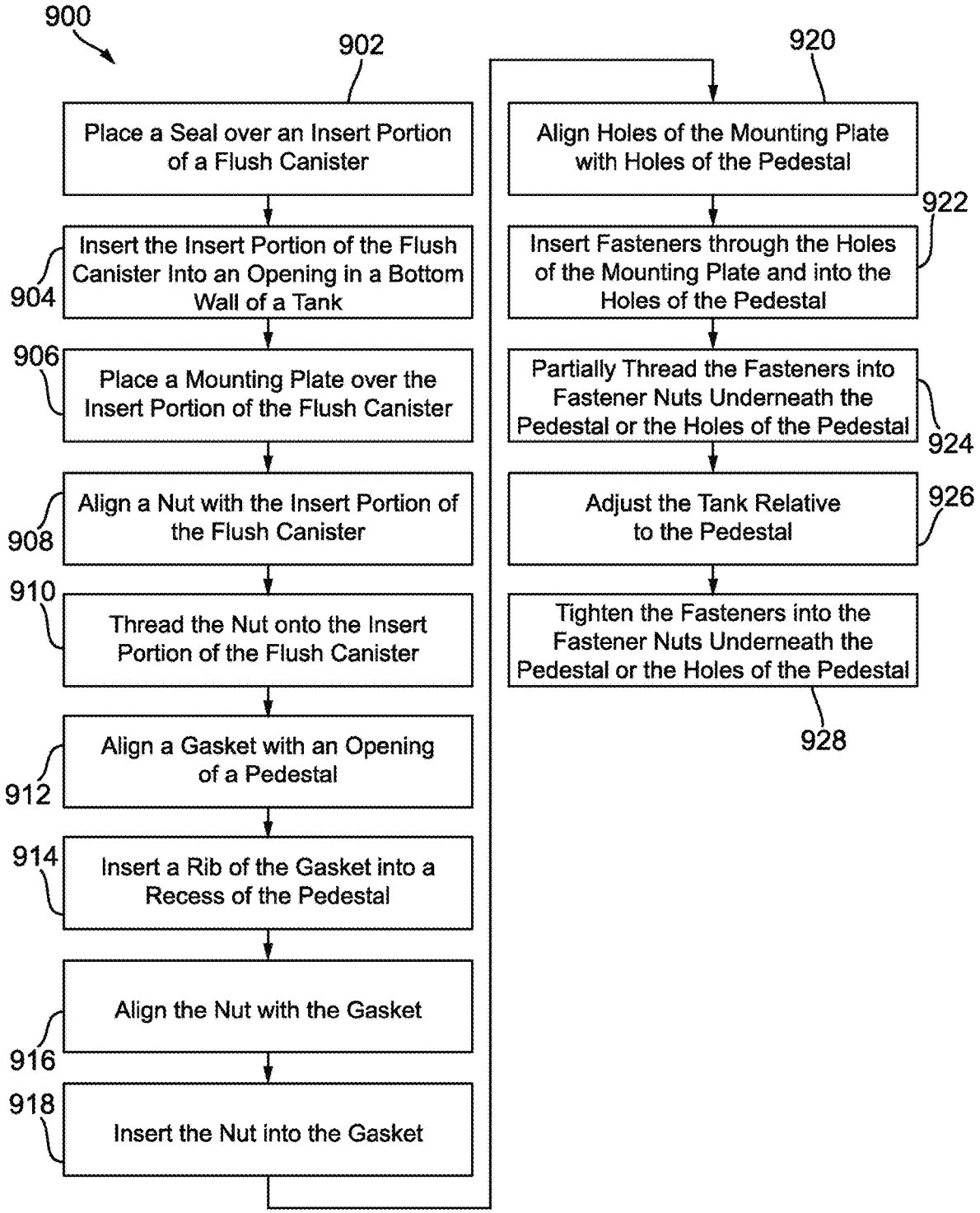
FIG. 9 is a flow chart for a process for coupling a tank of a toilet to a pedestal of the toilet such that the tank is aligned in a target position relative to the pedestal when the tank is coupled to the pedestal, according to an exemplary embodiment of the present disclosure.

FIG. 9 illustrates a process, shown as a process 900, for coupling the tank 102 to the pedestal 104 such that the tank 102 is aligned in a target position relative to the pedestal 104 when the tank 102 is coupled to the pedestal 104. The process 900 is implemented using the mounting assembly 201.

The process 900 begins, in block 902, with placing a seal 210 over an insert portion 204 of the flush canister 202. The block 902 may be performed such that the seal 210 contacts, or is in close proximity to, a flange portion 206 of the flush canister 202. The process 900 continues in block 904 with inserting the insert portion 204 of the flush canister 202 into an opening 200 of the bottom wall 106 in a bottom wall 106 of the tank 102. The block 904 may be performed such that the seal 210 contacts, or is in close proximity to, a top surface 208 of the bottom wall 106.

The process 900 continues, in block 906, with placing a mounting plate 244 over the insert portion 204 of the flush canister 202. The block 906 is performed such that the mounting plate 244 is separated from the flange portion 206 of the flush canister 202 and the seal 210 by the bottom wall 106. The block 906 may be performed such that the mounting plate 244 contacts, or is in close proximity to, a bottom surface 110 of the bottom wall 106 of the bottom wall 106.

The process 900 continues, in block 908, with aligning a nut 212 with the insert portion 204 of the flush canister 202. The process continues, in block 910, with threading the nut 212 onto the insert portion 204 of the flush canister 202 such that the nut 212 is tightly holding the mounting plate 244 against the bottom surface 110 of the bottom wall 106. The threading of the nut 212 onto the insert portion 204 of the flush canister 202 is effectuated through engagement of the threaded surface 214 of the nut 212 with the threaded surface 216 of the flush canister 202.

The process 900 continues, in block 912, with aligning a gasket 228 with an opening 238 of the pedestal 104. The process 900 continues, in block 914, with inserting a projection (e.g., protuberance, etc.), shown as a rib 240, of the gasket 228 into a recess (e.g., void, annular cavity, etc.), shown as a recess 242, of the pedestal 104 on a top surface 112 of the pedestal 104 of the pedestal 104. It is understood that the process 900 may be reconfigured in some applications such that the blocks 912 and 914 occur before any of the block 902, the block 904, the block 906, the block 908, and the block 910. In embodiments where the mounting assembly 201 is configured such that the gasket 228 does not include the rib 240 of the gasket 228 and the pedestal 104 does not include the recess 242 of the pedestal 104, the process 900 does not include the block 914.

The process 900 continues, in block 916, with aligning the nut 212 with the gasket 228. The process 900 continues, in block 918, with inserting the nut 212 into the gasket 228 such that the rounded surface 224 of the rounded portion 222 of the nut 212 is received within the concave surface 230 of the gasket 228 and such that the rounded surface 232 of the gasket 228 is received within the concave surface 226 of the rounded portion 222 of the nut 212.

The process 900 continues with, in block 920, with aligning holes 252 of the mounting plate 244 in the mounting plate 244 with holes 256 in the pedestal 104 in the top surface 112 of the pedestal 104 of the pedestal 104. The process 900 continues with, in block 922, with inserting the fasteners 254 through the holes 252 of the mounting plate 244 and into the holes 256 in the pedestal 104. The process 900 continues with, in block 924, partially threading the fasteners 254 into the fastener nuts 253. The block 924 is performed such that movement of the mounting plate 244, and therefore of the tank 102, relative to the pedestal 104 is facilitated after the partial threading of the fasteners 254 into the fastener nuts 253.

The process 900 continues with, in block 926, with adjusting the tank 102 relative to the pedestal 104. In block 926, a user may grasp the tank 102 and cause the tank 102 to tilt relative to the pedestal 104 such that the tank 102 is in a target position relative to the pedestal 104. For example, a user may place a level on top of the tank 102 and adjust the tank 102 until the level indicates that the tank 102 is level (e.g., relative to a ground surface, etc.). Once the tank 102 has been adjusted (e.g., is in the target position relative to the pedestal 104, etc.), the process 900 continues with, in block 928, tightening the fasteners 254 into the fastener nuts 253.

Once the fasteners 254 are tightened into the fastener nuts 253, the tank 102 is substantially held in the target position relative to the pedestal 104. However, should additional adjustment of the tank 102 relative to the pedestal 104 be desired, a user would only have to loosen the fasteners 254 (e.g., by loosening the fastener nuts 253, etc.) and adjust the tank 102 relative to the pedestal 104, as described in the block 926.

Figure 10:
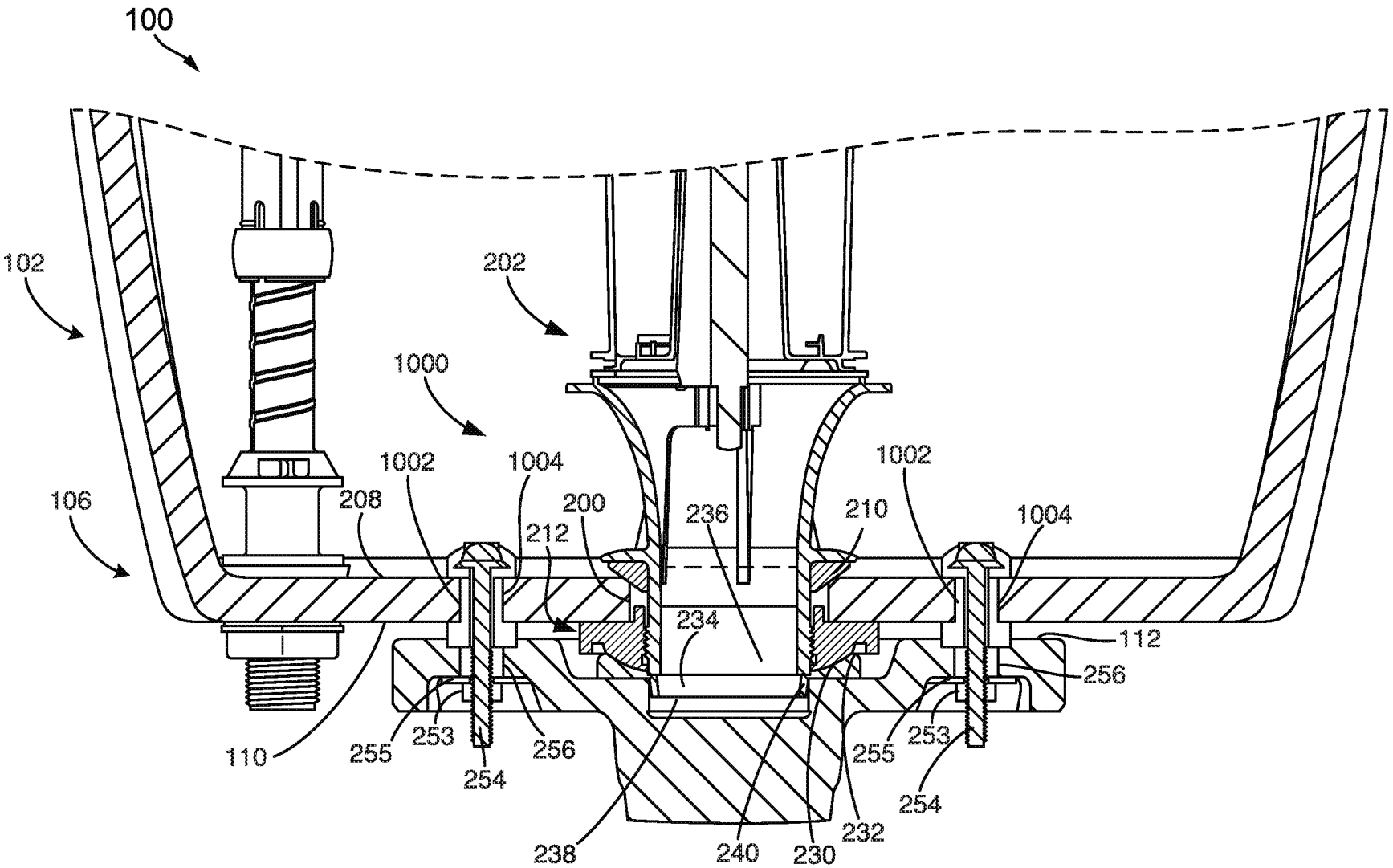
FIG. 10 is a detailed cross-sectional view of the toilet shown in FIG. 1, taken about plane A-A, and illustrating a mounting assembly, according to an exemplary embodiment of the present disclosure.

FIG. 10 illustrates a cross-sectional view of a portion of the toilet 100 taken about plane A-A, illustrating a system (e.g., assembly, etc.), shown as a mounting assembly 1000. The mounting assembly 1000 is similar to the mounting assembly 201. However, the mounting assembly 1000 does not include the mounting plate 244.

Rather than being separated from the bottom surface 110 of the bottom wall 106 by the mounting plate 244, as in the mounting assembly 201, the top surface 250 of the flange portion 220 of the nut 212 is in contact with the bottom surface 110 of the bottom wall 106.

Additionally, rather than being received within the pockets 260, the fasteners 254 extend through inserts, shown as inserts 1002, positioned in holes, shown as holes 1004, in the bottom wall 106. Using the mounting assembly 1000, the fasteners 254 are tightened against the top surface 208 of the bottom wall 106 rather than the top surface 246 of the mounting plate 244. A seal is formed between each of the inserts 1002 and one of the holes 1004 and a seal is formed between each of the fasteners 254 and one of the inserts 1002. Each of the fasteners 254 may be threaded into one of the inserts 1002.

In some embodiments, the mounting assembly 1000 does not include the inserts 1002. In these embodiments, a seal is formed between each of the fasteners 254 and one of the holes 1004. Each of the fasteners 254 may be threaded into one of the holes 1004.

Furthermore, the mounting assembly 1000 does not include the recess 242 of the pedestal 104. Rather than being received in the recess 242 of the pedestal 104, the rib 240 of the gasket 228 is positioned within the opening 238 of the pedestal 104.

As utilized herein, the terms "about," "parallel," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "parallel" is intended to encompass de minimus variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure.

The terms "coupled," "fastened," "threaded," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being jointed to one another.

References herein to the positions of elements (e.g., "top," "bottom," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the toilet 100, the mounting assembly 201, the process 900, the mounting assembly 1000, and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

While the mounting assembly 201 and the mounting assembly 1000 are illustrated as including two fasteners 254, it is understood that the mounting assembly 201 and the mounting assembly 1000 may include only one fastener 254, or may include three, four, or more fasteners 254.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or rem sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Also, the use of ranges of values (e.g., W to P, etc.) herein are inclusive of their maximum values and minimum values (e.g., W to P includes W and includes P, etc.), unless otherwise indicated. Furthermore, a range of values (e.g., W to P, etc.) does not necessarily require the inclusion of intermediate values within the range of values (e.g., W to P can include only W and P, etc.), unless otherwise indicated.

We claim:

1. A mounting assembly for mounting a tank and a pedestal of a toilet, the mounting assembly comprising:

a nut configured to be coupled to a flush canister of the tank, the nut having a first surface; and a gasket disposed about an opening of the pedestal and comprising a second surface configured for receiving the first surface of the nut;

wherein the nut and gasket facilitate tilting of the tank relative to the pedestal and the first surface of the nut rotates within the second surface of the gasket when the tank is tilted relative to the pedestal to facilitate positioning of the tank.

2. The mounting assembly of claim 1, wherein the flush canister comprises an insert portion that extends through the tank.

3. The mounting assembly of claim 1, wherein the nut is threaded into the flush canister.

4. The mounting assembly of claim 1, further comprising:

a mounting plate configured to be coupled to the pedestal and comprising an opening aligned with an opening of the pedestal, wherein the nut holds the mounting plate against the tank.

5. The mounting assembly of claim 4, further comprising:

a first fastener;

a second fastener;

a first fastener nut; and a second fastener nut.

6. The mounting assembly of claim 5, wherein the mounting plate further comprises:

a first hole receiving the first fastener; and a second hole receiving the second fastener;

wherein the pedestal further comprises:

a first hole receiving the first fastener;

a second hole in the pedestal receiving the second fastener; and wherein the mounting plate is partially coupled to the pedestal when the first fastener is inserted through the first hole of the pedestal and partially threaded into the first fastener nut and the second fastener is inserted through the second hole of the pedestal and partially threaded into the second fastener nut.

7. The mounting assembly of claim 6, wherein the nut and the gasket do not facilitate tilting of the tank relative to the pedestal when the first fastener is completely threaded into the first fastener nut or the second fastener is completely threaded into the second fastener nut.

8. The mounting assembly of claim 1, further comprising:

a seal receiving the flush canister, wherein the flush canister comprises a flange portion compressing the seal against the tank.

9. The mounting assembly of claim 1, wherein the first surface is a rounded surface.

10. The mounting assembly of claim 1, wherein the second surface is a concave surface.

11. The mounting assembly of claim 1, wherein the nut and the gasket form at least one ball and socket relationship.

12. The mounting assembly of claim 1, wherein the nut is rigid, the gasket is compressible, and the nut compresses the gasket against the pedestal when coupled to the pedestal.

13. A toilet comprising:

a tank comprising an opening and a bottom surface;

a pedestal comprising an opening and a top surface, the opening of the pedestal aligned with the opening of the tank; and a mounting assembly comprising:

a nut configured to be coupled to a flush canister of the tank, the nut having a first surface; and a gasket disposed about an opening of the pedestal and comprising a second surface configured for receiving the first surface of the nut;

wherein the nut and gasket facilitate tilting of the tank relative to the pedestal and the first surface of the nut rotates within the second surface of the gasket when the tank is tilted relative to the pedestal to facilitate positioning of the tank.

14. The toilet of claim 13, wherein the flush canister comprises an insert portion extending through the tank.

15. The toilet of claim 13, wherein the nut is threaded into the flush canister.

16. The toilet of claim 13, further comprising:

a mounting plate configured to be coupled to the pedestal and comprising an opening aligned with an opening of the pedestal, wherein the nut holds the mounting plate against the tank.

17. The toilet of claim 13, wherein the first surface is a rounded surface and the second surface is a concave surface.

18. The toilet of claim 13, wherein the nut and the gasket form at least one ball and socket relationship.

19. A method for coupling a tank of a toilet to a pedestal of a toilet, the method comprising:

inserting an insert portion of a flush canister into an opening of a bottom wall of the tank;

threading a nut onto the insert portion of the flush canister;

placing a gasket on the pedestal;

inserting the nut into the gasket; and tilting the tank relative to the pedestal so as to cause the nut to rotate within the gasket.

20. The method of claim 19, further comprising:

tightening one or more fasteners into one or more fastener nuts, after tilting the tank relative to the pedestal, so that the tank is secured to the pedestal.

* * * * *